US005472661A

United States Patent [19]

Gay

[11] Patent Number: 5,472,661

[45] Date of Patent: Dec. 5, 1995

[54] METHOD OF ADDING PARTICULATE ADDITIVES TO METAL PARTICLES

[75] Inventor: David E. Gay, Noblesville, Ind.

[73] Assignee: General Motors Corporation, Detroit, Mich.

[21] Appl. No.: 357,493

[22] Filed: Dec. 16, 1994

[51] Int. Cl.[6] ..... B22F 1/02; B22F 3/00

[52] U.S. Cl. ..... 419/36; 419/5; 419/10; 419/30; 419/35; 419/38; 419/61; 75/255; 428/546; 428/551

[58] Field of Search ..... 419/5, 10, 30, 419/35, 36, 38, 61; 75/255; 428/546, 551

[56] References Cited

U.S. PATENT DOCUMENTS 4,696,725 9/1987 Ochiai et al. ..... 252/62.54
5,173,206 12/1992 Dickens, Jr. et al. ..... 252/62.54
5,211,896 5/1993 Ward et al. ..... 264/126
5,271,891 12/1993 Gay et al. ..... 419/36
5,272,008 12/1993 Shain et al. ..... 428/407
5,395,695 3/1995 Shain et al. ..... 428/407

*Primary Examiner*—Donald P. Walsh
*Assistant Examiner*—Scott T. Bluni
*Attorney, Agent, or Firm*—Lawrence B. Plant

[57] ABSTRACT

Method of distributing and retaining insoluble additive particles uniformly throughout a mass of moldable metal particles. The additive particles are suspended in a solution of a polymeric binder and spray-coated onto the metal particles. When the solvent evaporates, the additives remain glued to the metal particles by the binder.

7 Claims, 2 Drawing Sheets

METHOD OF ADDING PARTICULATE ADDITIVES TO METAL PARTICLES

This invention relates to a method of distributing and retaining a minority amount of additive particles throughout a mass of moldable metal particles.

BACKGROUND OF THE INVENTION

Moldable metal particles take essentially one of two forms, i.e., encapsulated and unencapsulated. Encapsulated metal particles comprise a metal core encased in a polymeric shell, and are compression molded to form a variety of products. For example, soft magnets are molded from polymer encapsulated ferromagnetic particles such as iron, and certain silicon, aluminum, nickel, cobalt, etc., alloys thereof (hereafter "iron"). Such soft magnets are readily demagnetized with less than about 200 Oersteds coercive force. Polymeric shell materials useful for such soft magnets include thermoplastic polyetherimide, polyamideimide, polyethersulfone, polycarbonate and polyphenylene ether, inter alia. U.S. Patent Ward et al. 5,211,896 discloses one example of such a material wherein the polymeric shell is spray-coated from a solution thereof to form a continuous film on the surfaces of the metal particles. Permanent (i.e., hard) magnets are also known to be compression molded from such ferromagnetic particles as magnetic ferrites, rare-earth metal alloys (e.g., Sm-CO, Fe-Nd-B, etc.), and the like spray-coated to form a polymeric shell. Shain et al. 5,272,008, for example, discloses one such hard magnet-forming material comprising iron-neodymiumboron particles encapsulated in a spray-coated composite polymeric shell comprising an epoxy underlayer overcoated with a polystyrene outer layer. Other metals and polymer shells have been proposed for various applications. Unencapsulated metal particles, on the other hand, have no such polymer shell, and are used primarily in the manufacture of sintered products.

In Ward et al., and Shain et al. supra, the shell-forming polymers are completely dissolved in an appropriate solvent, and a fluidized stream of the metal particles spray-coated with the solution, using the co-called "Wurster" process. Wurster-type spray-coating equipment comprises a cylindrical outer vessel having a perforated floor through which a heated gas passes upwardly to heat and fluidize a batch of metal particles to be coated therein. A concentric, open-ended, inner cylinder is suspended above the center of the perforated floor of the outer vessel. A spray nozzle centered beneath the inner cylinder sprays a solution of the shell-forming polymer, dissolved completely in a solvent, upwardly into the inner cylinder (i.e., the coating zone) as the fluidized metal particles pass upwardly through the spray in the inner cylinder. The particles circulate upwardly through the center of the inner cylinder and downwardly between the inner and outer cylinders. The gas (e.g., air) that fluidizes the metal particles also serves to vaporize the solvent causing the dissolved shell-forming polymer to deposit as a smooth continuous film onto each particle's surface. After repeated passes through the coating zone in the inner cylinder, a sufficient thickness of polymer accumulates over the entire surface of each particle as to completely encapsulate such particle. Other spray-coating processes/apparatus are described in Smith-Johnson 3,992,558; Lindlof et al. 3,117,027; Reynolds 3,354,863; Wurster 2,648,609 and Wurster 3,253,944.

It is known to mechanically admix certain insoluble particulate additives with both encapsulated and unencapsulated metal particles. Hence for example, it is known to admix lubricant particles with such metal particles—see, for example, U.S. Patent Rutz et al. 5,198,137. It is likewise known to coat the surfaces of magnetic rare earth metal alloy particles with an antioxidant to provide long term magnetic stability—see, for example, Shain et al. supra. Still further, it is known to admix alloyant particles with unencapsulated metal particles for alloying with the metal particles during sintering e.g., see Semel 4,834,800. For example, graphite particles have heretofore been admixed with iron particles to carburize the iron during sintering. Other common alloyant particles for sinter-alloying include nickel, copper, molybdenum, sulfur and tin which may be either dry mixed with the metal particles or wet mixed in the presence of a solution of a binder such that upon drying the alloyant particles are bonded to the metal particles and to each other. Such alloyants comprise a minority amount of the particulate mass (i.e., less than about 5%–6% by weight). Finally, it is known to admix inert fillers (e.g., talc, quartz, etc.)with encapsulated metal particles, e.g., see Ebling 3,725,521.

SUMMARY OF THE INVENTION

This invention contemplates a process for distributing and retaining a minority amount (i.e., less than about 6% by weight) of small insoluble additive particles uniformly throughout a mass of larger moldable metal particles by spray-coating a stream of the metal particles with a slurry of the insoluble additive particles, and allowing the coating to dry so as to leave the insoluble additive particles glued firmly to the surfaces of each and every metal particle where it is most effective. The slurry comprises the insoluble additive particles (e.g., lubricants, alloyants, antioxidants, inert fillers, etc.) suspended in a solution of a polymeric binder and a solvent for the binder. When the solvent evaporates, the binder precipitates out and over the surfaces of the metal particles and embeds the additive particles therein so as to glue the additive particles substantially uniformly over such surfaces. The invention is useful with both encapsulated and unencapsulated metal particles. Unencapsulated metal particles destined for sintering will preferably utilize a fugitive binder for complete removal thereof during sintering.

DETAILED DESCRIPTION OF PREFERRED EMBODIMENTS OF THE INVENTION

Figure 1:
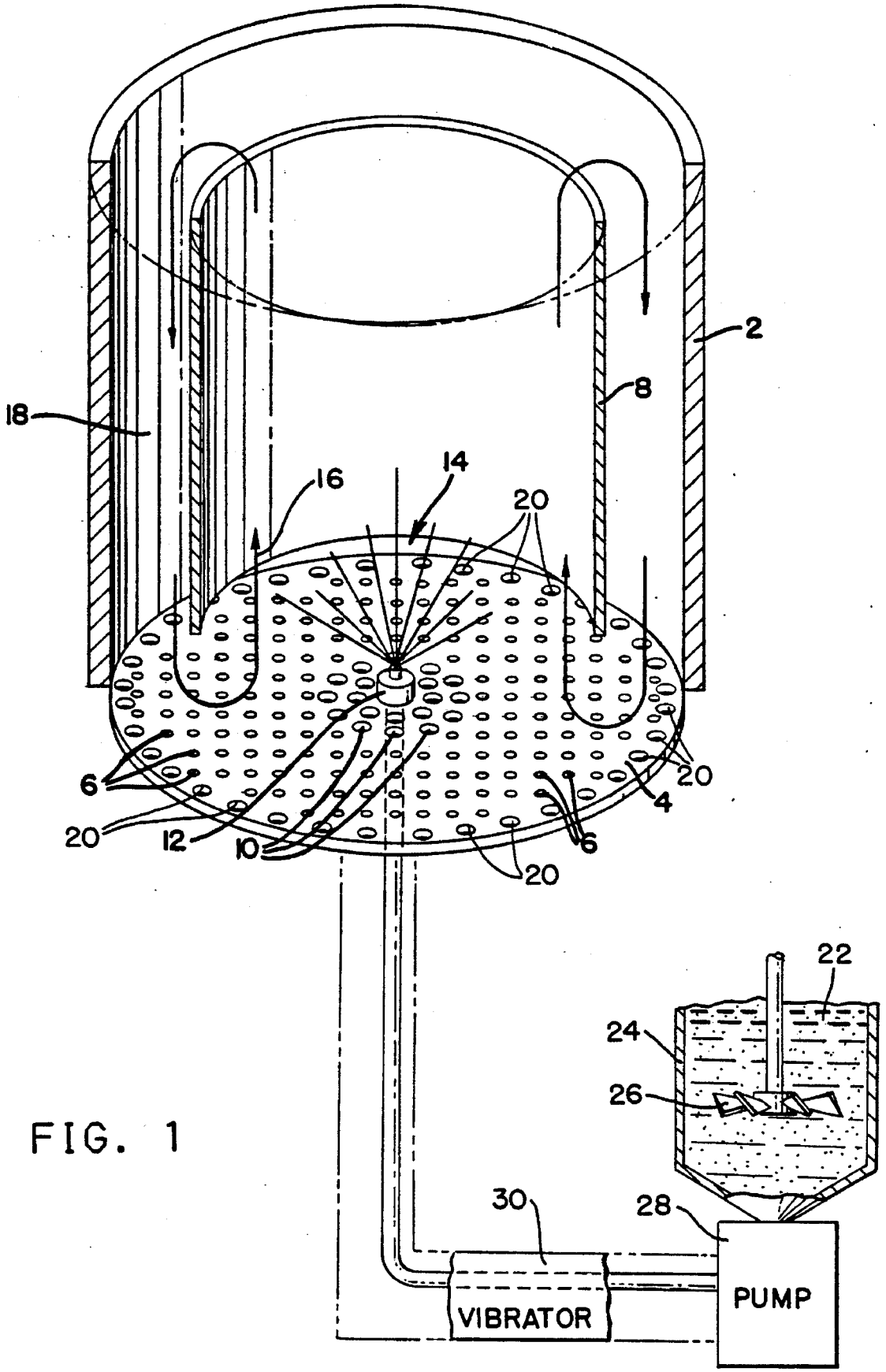
FIG. 1 illustrates, in a sectioned perspective view, a Wurster-type fluidized stream coater.

In accordance with the present invention, insoluble additive particles (e.g., lubricants, alloyants, antioxidants, fillers, etc.) are deposited over the surfaces of the metal particles using a fluidized-stream-type method (e.g., Wurster process) of spray-coating, wherein a slurry comprising a suspension of the insoluble additive particles in a carrier solution of the binder polymer is sprayed into a fluidized stream of the metal particles, and the solvent for the binder evaporated so as to leave the additive particles embedded in the binder polymer which coats substantially the entire surface of each of the metal particles. More specifically, a carrier solution is prepared comprising a soluble, thermoplastic, film-forming polymer binder dissolved in a suitable solvent. A plurality of small additive particles are suspended in the binder solution so as to provide a sprayable slurry. The mean size of the additive particles is much smaller than the mean size of the host metal particles, but larger than the thickness of the binder polymer film layer that holds them to the surface of the larger metal particles. The metal particles are then fluidized in a gas stream (e.g., in a Wurster coater), and spray-coated with the slurry so as to coat the surfaces of each of the metal particles with the slurry. Subsequent evaporation of the solvent from the binder solution leaves the insoluble additive particles embedded in the soluble thermoplastic polymer binder and covering the surfaces of the metal particles. With the solvent removed, the additive-coated host metal particles each carries with it its own additive adhering to the surface thereof. As a result, the insoluble additive particles are distributed substantially evenly throughout the particle mass, and are not susceptible to segregation or separation therefrom during handling/processing. Moreover, the insoluble additive particles cover the exterior surfaces of the metal particles precisely where they are most effective as lubricants, alloyants, antioxidants, etc.

The present invention is useful for coating the host metal particles with a variety of additives. Hence for example, unencapsulated metal particles may be coated with: (1) lubricants such as stearates (e g , zinc stearate or ACRAWAX™) fluorocarbons (e.g., TEFLON™), or other lubricants well known to those skilled in the metal sintering art; or (2) alloyants such as graphite, nickel, copper, molybdenum, sulfur inter alia (i.e., for iron particles). Other appropriate alloyants may be added to metal particles other than iron as is well known in the art. Likewise, encapsulated metal particles (e.g., ferromagnetic metal particles) may be coated with: (1) insoluble organic lubricant particles such as stearates (e.g., ACRAWAX™), fluorocarbons (e.g., TEFLON™), or the like, and (2) insoluble antioxidants such as hindered phenols (e.g., Topanol 205), thioesters (e.g., Carstab DLTDP) and hydrazide OAHB), or the like.

Metal particles to be coated in accordance with the present invention will have a particle size that depends on the particular material being used and the intended application therefor. Unencapsulated metal particles destined for sintering will typically have a mean particle size of about 95 microns and about 175 microns. Encapsulated ferromagnetic metal particles, on the other hand, will typically have a mean particle size of about 100 microns to about 180 microns for soft magnetic applications, and about 20 microns to about 100 microns for hard magnetic applications. The additive particles to be glued to the surfaces of the metal particles will be much smaller than the host metal particles and will generally have a mean particle size between about 5 microns and about 30 microns depending on the particular material being used and the application therefor. Hence for example, (1) ACRAWAX™ (i.e., ethylene bisstearateamide) lubricant particles will have a particle size of about 6 microns, (2) polytetrafluoroethylene (PTFE) lubricant particles will have a mean particle size of about 5 microns and 15 microns, and (3) graphite alloyant will have a mean particle size of between about 2 microns and 10 microns. The actual particle sizes of the respective metal particles and additive particles is not critical. Rather, it is important only that the additive particles be significantly smaller than the host metal particle so that a plurality of such additive particles can readily cover the surface of the host particle. Preferably, the mean particle size of the host metal particles will be about ten to one hundred times (10X–100X) larger than the mean particle size of the additive particles.

Insoluble lubricant particles may be added to both encapsulated and unencapsulated metal particles. In the case of unencapsulated metal particles destined for sintering, the lubricant particles will comprise about 0.05% by weight to about 0.20% by weight of the particle mass. In the case of encapsulated ferromagnetic metal particles for forming hard and soft magnets, the lubricant particles will comprise about 0.05% to about 0.50% by weight of the particle mass and about 25% to about 75% by weight of the binder-lubricant layer. Encapsulated particle masses having higher amounts provide little additional benefits and tend to weaken moldings made therefrom. No more binder is required than is needed to embed the lubricant particles, and glue them to the surfaces of the metal particles. Hence, the binder content of the particle mass will comprise only about 0.05% by weight to about 0.2% by weight of the total particle mass. Suitable binders for lubricants deposited onto encapsulated metal particles include polystyrene, polyetherimide, polyacrylates, polycarbonates and polyvinylacetate. Similarly, suitable binders for lubricants deposited onto unencapsulated metal particles include polyglycols, cellulosic materials, polyesters, and polyvinyl alcohol. For unencapsulated metal particles, the binder will preferably comprise a fugitive polymer such as polyphenylene oxide or the like which is completely removed during sintering, and leaves no residue in the finished product (e.g., see Gay et al. 5,271,891). However for certain applications, it may be desirable to use a binder which leaves a residue that would be beneficial to the sintered product or sintering operation. Hence for example, it may be desirable, in some circumstances, to use a binder which pyrolyses during sintering to leave a carbon residue for carburizing the host metal particle.

Insoluble alloyant particles may be added to host metal particles using the process of the present invention. For alloying to be uniform, the alloyant must be distributed uniformly throughout the particle mass and contact as much of the host particle's surface as possible. In accordance with the present invention, the alloyant particles cover and are glued to the surfaces of each and every metal particle, and hence located precisely where they can be the most effective. The alloyant particles will comprise less than about 5%–6% by weight of the particle mass and usually less than about 3% by weight. For example graphite additions will typically be about 0.5% to about 1.0% by weight, and copper addition will typically be about 2% to about 5% by weight. No more binder is required than is needed to embed the alloyant particles, and glue them to the surface of the metal particles. Hence, the binder content of the particle mass will comprise only about 0.05% by weight to about 0.20% by weight of the total particle mass. Suitable binders for gluing alloyants onto the surfaces of unencapsulated metal particles are numerous and include polyethylene glycol, polypropylene glycol, glycerine, polyvinyl alcohol, cellulosic esters or ethers, methacrylate polymers or copolymers, alkyd resins, polyurethane resins, polyester resins, polyphenylene oxide, polyacrylates, polyphenylsulfone, and polysulfone. The binder will preferably comprise a fugitive polymer such as polyphenylene oxide, or the like, which is completely removed during sintering and leaves no residue in the finished product. However for certain applications, it may be desirable to use a binder which leaves a residue that would be beneficial to the sintered product or sintering operation, e.g., carbon for carburizing the host metal particle.

Insoluble antioxidant particles may be added to the surface of reactive host metal particles, such as FeNdB hard magnetic alloys, to retard oxidation thereof and a consequent reduction in magnetic properties. Such insoluble antioxidants include materials such as hindered phenols, thioesters, hindered amines, hydroquinones, and phosphites, inter alia. In the case of encapsulated such hard magnetic alloys, the antioxidant particles will comprise about 0.30% to about 0.60% by weight of the total particle mass, about 75% to about 85% by weight of the binder-antioxidant layer, and will be deposited directly onto the host metal particle beneath any other polymeric shell that might be formed thereover. No more binder is required than is needed to embed the antioxidant particles, and glue them to the surface of the metal particles. Hence, the binder content of the particle mass will comprise only about 0.05% by weight to about 0.20% by weight of the total particle mass. Suitable binders for antioxidant particles include epoxies, polyvinylidene difluoride, polyimides, polyglycols and polyesters.

The solvent for the binder will, of course, vary with the particular binder polymer being utilized. However, some solvents that have been successfully used include methylene chloride, acetone, ethanol, toluene and N-methylpyrridone. Likewise, the concentration of the binder in the solution will be a function of the solubility of the binder in the particular solvent chosen. Where possible, binder concentrations of at least about ten percent (10%) by weight are preferred in order to accelerate the time it takes to coat the host metal particles, and to minimize the amount of solvent that needs to be handled/recovered. Lower concentrations can, of course, be used, but at the expense of longer coating times and more costly solvent costs.

To deposit the additive particles onto the surface of the host metal particles, the additive particles are suspended in a solution of the binder so as to form a slurry thereof, and preferably spray-coated onto a fluidized stream of the metal particles using a Wurster-type apparatus schematically illustrated in FIG. 1. Essentially, the Wurster-type apparatus comprises an outer cylindrical vessel 2 having a floor 4 with a plurality of perforations 6 therein, and an inner cylinder 8 concentric with the outer vessel 2 and suspended over the floor 4. The perforations 10 and 20 at the center of the floor 4 and at the periphery of the plate 4 respectively are larger than those lying therebetween. A spray nozzle 12 is centered in the floor 4 beneath the inner cylinder 8, and directs a spray 14 of the additive-binder slurry to be coated into the coating zone within the inner cylinder 8. The metal particles (not shown) to be encapsulated are placed atop the floor 4, and the vessel 2 closed. Sufficient warm air is pumped through the perforations 6 in the floor 4 to fluidize the metal particles and cause them to circulate within the coater in the direction shown by the arrows 16. In this regard, the larger apertures 10 in the center of the floor allow a larger volume of air to flow upwardly through the inner cylinder 8 than in the annular zone 18 between the inner and outer cylinders 8 and 2, respectively. As the particles exit the top of the inner cylinder 8 and enter the larger cylinder 2, they decelerate and move radially outwardly and fall back down through the annular zone 18. The large apertures 20 adjacent the outer vessel provide more air along the inside face of the outer wall of the outer vessel 2 which keeps the particles from statically clinging to the outer wall as well as provides a transition cushion for the particles making the bend into the center cylinder 8.

During startup, the metal particles are circulated, in the absence of any coating spray, until they are heated to the desired coating temperature by the heated air passing through the floor 4. After the metal particles have been thusly preheated, the desired additive slurry 22 is mixed in a mixer 24 by impeller 26, or the like, and pumped via pump 28 into the spray nozzle 12 where a stream of air sprays it upwardly into the circulating bed of metal particles. The process continues until the desired amount of additive and binder have been deposited onto the surfaces of the metal particles. A vibrator 30, or the like, surrounds the plumbing between the pump 28 and nozzle 12 and induces sufficient vibrations (i.e., sonic or ultrasonic) into the slurry therein to keep the additive particles in suspension all the way to the nozzle 12. A suitable dispersing agent such as silicones or fluorochemicals may be added to the slurry 22 to also help keep the additives in suspension. The amount of air needed to fluidize the host ferromagnetic particles varies with the weight and batch size of the particles, the precise size and distribution of the perforations in the floor 4, and the height of the inner cylinder 8 above the floor 4. Air flow is adjusted so that the bed of metal particles becomes fluidized and circulates within the coater as described above.

Figure 2:
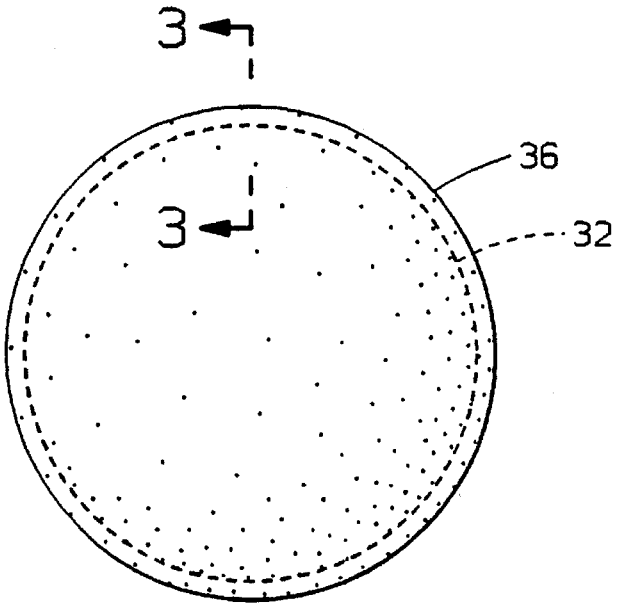
FIG. 2 illustrates a metal particle coated according to the present invention.
Figure 3:
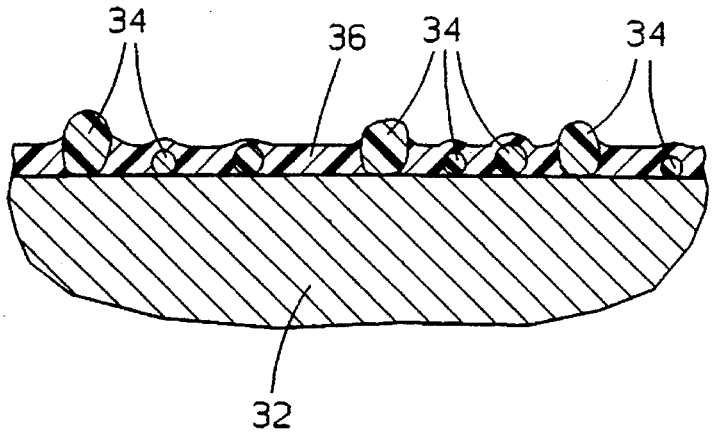
FIG. 3 illustrates a magnified portion of FIG. 2.

FIGS. 2 and 3 illustrate a host metal particle 32 having a plurality of insoluble additive particles 34 embedded in a continuous film of binder 36 on the surface thereof. Such a binder-additive coating may also be used in conjunction with another, matrix-forming polymer layer (not shown). In such case the binder-additive layer may either be an underlayer (e.g., when antioxidants are used) or an overlayer (e.g., when lubricants are used).

EXAMPLE 1

In one specific example of the invention, 15 Kg of iron particles (average particles size 100 micron), identified as grade 1000C by their manufacturer (Hoeganaes Metals), were first spray-coated with a solution comprising 10% by weight polyetherimide (i.e., ULTEM 1000) and 90% by weight methylene chloride (hereafter $MeCl_2$). The thusly coated particles were then spray-coated with a slurry comprising 9% by weight ethylene bisstearateamide (i.e., ACRAWAX C), 4.5% by weight ULTEM 1000 and 86.5 by weight $MeCl_2$ in a Wurster-type coater purchased from the Glatt Corporation. The ACRAWAX C had an average particle size of about 6 microns. The coater had a seven inch (7") diameter outer vessel (i.e., at the level of the perforated floor) and a three inch (3") diameter inner cylinder which is ten inches (10") long/tall. The outer vessel widens to about 9 inches diameter through a distance of 16 inches above the floor and then becomes cylindrical. The bottom of the inner cylinder is about one half inch (½") above the floor of the coater. The fluidizing air is pumped through the perforations at a rate of about 350 $m^3$/hr. and a temperature of about 55° C. which is sufficient to preheat the iron particles and circulate them through the apparatus as described above. The ACRAWAX C slurry is air sprayed through the nozzle at a flow rate of about 40 grams/min. for 30 min. The finished shell comprised about 0.8% by weight of the encapsulated iron particles. About 0.3% by weight of the particles was made up of the outer layer. About 0.2% by weight of the encapsulated iron particles was made up of the ACRAWAX C particles. Hence 75% of the outer layer can and 25% of the total shell comprised ACRAWAX.

Soft magnetic cores in the shape of a toroid were then compression molded from the thusly coated iron particles. The coated particles were loaded into a supply hopper standing offset from and above the molding press. The particles were gravity fed into an auger-type particle feeding mechanism which substantially uniformly preheats the particles to about 140° C. while they are in transit to the tooling (i.e., punch and die) which is heated to about 285° C. The preheated particles were fed into a heated feed hopper which in turn feeds the molding die via a feed shoe which shuttles back and forth between the feed hopper and the die. After the die was filled with particles, a heated punch entered the die and pressed the particles therein under a pressure of about 50 tons per square inch (TSI) so as to cause the shell to melt and to fuse to the other encapsulated iron particles and thereby form a continuous matrix for the iron particles. The pressed part was then removed from the die. Samples so made had a density of 7.35 g/cc (as compared to a theoretical density of 7.57), a magnetic permeability of 200 G/Oe, core losses of 2200 J/m$^3$, and electrical resistivity of (0.15 Ω-cm). Identical control samples processed in the same manner, but without the lubricant present, yielded a density of only 7.25 g/cc, a magnetic permeability of only 170 G/Oe core losses of 2200 J/m$^3$ and a resistivity of 0.15 Ω-cm.

EXAMPLE 2

In another example of the invention, 15 kg of iron particles (average particle size 100 micron), identified as grade 1000C by their manufacturer (Hoeganaes Metals), were first spray-coated with a solution comprising 10% by weight polyetherimide (i.e., ULTEM 1000) and 90% by weight $MeCl_2$. The thusly coated particles were than spray-coated with a slurry comprising 7% by weight PTFE (i.e., Teflon MP 1100™), 2.3% by weight methyl methacrylate-butyl methacrylate polymer (i.e., ACRYLOID B-66™) and 90.7% by weight acetone in a Wurster-type coater purchased from the Glatt Corporation. The PTFE had an average particle size of about 5 microns. The coater had a seven inch (7") diameter outer vessel (i.e., at the level of the perforated floor) and a three inch (3") diameter inner cylinder which is ten inches (10") long/tall. The outer vessel widens to about 9 inches diameter through a distance of 16 inches above the floor and then becomes cylindrical. The bottom of the inner cylinder is about one half inch (½") above the floor of the coater. The fluidizing air is pumped through the perforations at a rate of about 350 m$^3$/hr. nd a temperature of about 55° C. which is sufficient to preheat the iron particles and circulate them through the apparatus as described above. The PTFE slurry is air sprayed through the nozzle 12 at a flow rate of about 40 grams/min. for 25 min. to form a shell which comprised about 0.65% by weight of the encapsulated iron particles. About 0.4% by weight of the encapsulated particles was made of the outer PTFE-acrylate layer. About 0.3% By weight of the encapsulated iron particles was made up of the PTFE particles. Hence 75% of the outer layer and 46% of the total shell comprised PTFE.

Soft magnetic cores in the shape of a toroid were then compression molded from the thusly coated iron particles. The coated particles were loaded into a supply hopper standing offset from and above the molding press. The particles were gravity fed into an auger-type particle feeding mechanism which substantially uniformly preheats the particles to about 110° C. while they are in transit to the tooling (i.e., punch and die) which is heated to about 230° C. The preheated particles were fed into a heated feed hopper which in turn feeds the molding die via a feed shoe which shuttles back and forth between the feed hopper and the die. After the die was filled with particles, a heated punch entered the die and pressed the particles therein under a pressure of about 50 TSI so as to cause the shell to melt and to fuse to the other encapsulated iron particles and thereby form a continuous matrix for the iron particles. The pressed part was then removed from the die. Samples so made had a density of 7.45 g/cc (as compared to a theoretical density of 7.69), a magnetic permeability of 350 G/Oe, core losses of about 1900–2200 J/m$^3$, and electrical resistivity of (1.1 Ω-cm). Identical control samples processed in the same manner, but without the lubricant present, yielded a density of only 7.25 g/cc, a magnetic permeability of only 170 G/Oe core losses of 2200 J/m$^3$ and a resistivity of 0.15 Ω-cm.

EXAMPLE 3

In another example of the invention, 15 Kg of Nd-B-Fe magnetic particles (average particle size 100 microns), identified as grade MQP-B by their manufacturer (General Motors Corporation), were first spray-coated with a solution comprising 10% by weight epoxy (i.e., Epoxy 164 from Shell Oil Co.) and 90% by weight acetone. The thusly-coated particles were then spray-coated with a slurry comprising 2.9% by weight ethylene bisstearateamide (i.e., ACRAWAX C), 48% by weight polystyrene and 92.3% by weight Toluene in a Wurster-type coater purchased from the Glatt Corporation. The ACRAWAX C had an average particle size of about 6 microns. The coater had a seven inch (7") diameter outer vessel (i.e., at the level of the perforated floor) and a three inch (3") diameter inner cylinder which is ten inches (10") long/tall. The outer vessel widens to about 9 inches diameter through a distance of 16 inches above the floor and then becomes cylindrical. The bottom of the inner cylinder is about one half inch (½") above the floor of the coater. The fluidizing air is pumped through the perforations at a rate of about 350 m$^3$/hr. and a temperature of about 35° C. which is sufficient to preheat the Nd-B-fe particles and circulate them through the apparatus as described above. The ACRAWAX C slurry is air sprayed through the nozzle 12 at a flow rate of about 30 grams/min. for 50 min. to form a shell which comprises about 2.3% by weight of the encapsulated Nd-B-Fe particles. About 0.8% by weight of the encapsulated particles was made up of the outer ACRAWAX-styrene layer. About 13% by weight of the total polymer shell and 37% by weight of the ACRAWAX-styrene layer comprised ACRAWAX C.

Pellets were then compression molded from the thusly coated Nd-B-fe particles. The coated particles were loaded into a supply hopper standing offset from and above the molding press. The particles were fed into a feed hopper which in turn feeds the molding die via a feed shoe which shuttles back and forth between the feed hopper and the die. After the die was filled with particles, a punch entered the die and pressed the particles therein under a pressure of about 50 TSI so as to cause the shell to fuse to the other encapsulated Nd-B-fe particles and thereby form a continuous matrix for the Nd-B-Fe particles. The pellets were then removed from the die and cured at 175° C. for 30 minutes. Samples so made had a density of 5.9 g/cc (as compared to a theoretical density of 6.9), and a residual induction (Br) of 8.13 kilogauss. Identical control samples processed in the same manner, but without the lubricant present, yielded a density of only 5.7 g/cc, and had a residual induction of 7.94 kilogauss.

EXAMPLE 4

In another specific example of the invention, 15 Kg of iron particles (average part size 100 micron), identified as Distalloy 4600 A by their manufacturer (Hoeganaes Metals), were first spray coated with a solution comprising 2.5% by weight polyphenylene oxide (i.e., Noryl), 5% graphite powder, and 92.5% by weight chloroform, in a Wurster-type coater purchased from Glatt Corp. The graphite had an average particles size of 2 microns. Distalloy is a partially alloyed iron powder which contains 1.8% Ni, 50% Mo, 1.5% Cu, and the balance Fe. The coater had a seven inch (7") diameter outer vessel (i.e., at the level of the perforated floor) and a three inch (3") diameter inner cylinder which is ten inches (10") long/tall. The outer vessel widens to about 9 inches diameter through a distance of 16 inches above the floor and then becomes cylindrical. The bottom of the inner cylinder is about one half inch (½") above the floor of the coater. The fluidizing air is pumped through the perforations at a rate of about 350 $m^3$/hr. and a temperature of about 65° C. which is sufficient to preheat the iron particles and circulate them through the apparatus as described above. The graphite slurry is air sprayed through the nozzle at a flow rate of about 40 grams/min. for 30 min. The finished coating comprised about 1.5% by weight of the coated iron alloy particles. About 1% by weight of the coated particles was made up of the graphite powder and 0.5% by weight of the coated iron alloy particles was the binder. Hence 67% of the coating was graphite and 33% of the shell was PPO.

Transverse rupture bars were then compression molded from the thusly coated iron alloy particles. The coated particles were loaded into a supply hopper standing offset from and above the molding press. The particles were gravity fed into an auger-type particle feeding mechanism which substantially uniformly preheats the particles to about 140° C. while they are in transit to the tooling (i.e., punch and die) which is heated to about 285° C. The preheated particles were fed into a heated feed hopper which in turn feeds the molding die via a feed shoe which shuttles back and forth between the feed hopper and the die. After the die was filled with particles, a heated punch entered the die and pressed the particles therein under a pressure of about 50 tons per square inch (TSI) so as to cause the binder to melt and to fuse to the other coateded iron particles and thereby form a continuous matrix for the iron particles. The pressed parts were then removed from the die. The parts were sintered at 2050° F. using a disassociated ammonia atmosphere to remove the PPO and carburize the metal. Samples so made had a density of 7.45 g/cc (as compared to a theoretical density of 7.80). These samples had a carbon content of 0.60 and were able to be hardened and austempered because of the high carbon levels.

EXAMPLE 5

In another example of the invention, 15 Kg of Nd-B-Fe magnetic particles (average particles size 100 microns), identified as grade MQP-B by their manufacturer (General Motors Corporation), are first spray coated with a slurry comprising 2.5% by weight hindered phenol (Topanol), 2.5% by weight thioester (Carstab DLTDP), 2.5% by weight hydrazide (OAHB), 2.5% by weight epoxy (Shell 164), and 90% by weight Acetone solvent. The thusly-coated particles are then spray coated with a solution comprising 10% by weight epoxy (Shell 164) and 90% by weight acetone. The thusly coated particles are then spray coated with a solution of 10% by weight polystyrene and 90% by weight toluene, all three coats are deposited in a Wurster-type coater purchased from Glatt Corp. The coater has a seven inch (7") diameter outer vessel (i.e., at the level of the perforated floor) and a three inch (3") diameter inner cylinder which is ten inches (10") long/tall. The outer vessel widens to about 9 inches diameter through a distance of 16 inches above the floor and then becomes cylindrical. The bottom of the inner cylinder is bout one half inch (½") above the floor of the coater. The fluidizing air is pumped through the perforations at a rate of about 350 $m^3$/hr. and a temperature of about 35° C. which is sufficient to preheat the Nd-B-Fe particles and circulate them through the apparatus as described above. The antioxidant slurry is air sprayed through the nozzle 12 at a flow rate of about 30 grams/min. for 50 min. to form a shell which comprises about 2.6% by weight of the encapsulated Nd-B-Fe particles. About 0.6% by weight of the encapsulated particles will be made up of the inner antioxidant-epoxy layer. About 17% by weight of the total polymer shell and 23% by weight of the antioxidant-epoxy layer comprised the antioxidant mixture (i.e., Topanol+Carstab DLTDP+OAHB).

Pellets are then compression molded from the thusly coated Nd-B-Fe particles in the same manner as described above in conjunction with Example 3, and magnets molded therefrom are expected to have lower magnetic irreversible losses (i.e., heat aging) than comparable samples made without the antioxidant layer contiguous the Nd-B-Fe particles.

The embodiments of the invention in which an exclusive property or privilege is claimed are defined as follows:

1. A method of distributing and retaining a minority amount of insoluble additive particles having a first average particle size substantially uniformly throughout a mass of moldable metal particles having a second average particle size greater than said first average particle size comprising the steps of:

suspending a plurality of said metal particles in a stream of gas;

spraying a slurry of said additive particles into said stream so as to coat the surfaces of each of said metal particles with said slurry, said slurry comprising said additive particles suspended in a solution of a polymeric binder and a solvent for said binder; and evaporating said solvent from said coated metal particles so as to precipitate said binder, and entrap said additive particles in said binder on said surfaces.

2. A method according to claim 1 including the step of encapsulating said metal particles in a polymer shell prior to coating said metal particles with said additive particles.

3. A method according to claim 1 wherein said metal particles are destined for sintering, said additive is an alloyant for said metal particles and said binder is a fugitive binder, and wherein said method includes the steps of pressing said mass into a desired shape, heating said pressed mass to remove said binder, and sintering said pressed mass to alloy said alloyant with said metal particles and bond said metal particles together.

4. A method according to claim 1 wherein said additive particles are selected from the group consisting of alloyants, lubricants, and antioxidants.

5. A method according to claim 2 wherein said additive is a lubricant.

6. A method according to claim 1 wherein said metal particles comprise a rare earth magnetic alloy, said additive comprises an antioxidant and said method includes the step of encapsulating said metal particles in a polymer shell after coating said metal particles with said antioxidant.

7. A method according to claim 1 wherein said metal particles are destined for sintering, said additive is a lubricant and said method includes the steps of pressing said mass into a desired shape and heating said pressed mass to remove said lubricant from said pressed mass.

* * * * *